US011572260B1

(12) United States Patent
Newman

(10) Patent No.: US 11,572,260 B1
(45) Date of Patent: Feb. 7, 2023

(54) ELECTRIC WELL SERVICE RIG WITH SPEED LIMITER

(71) Applicant: Frederic M Newman, Midland, TX (US)

(72) Inventor: Frederic M Newman, Midland, TX (US)

( * ) Notice: Subject to any disclaimer, the term of this patent is extended or adjusted under 35 U.S.C. 154(b) by 0 days.

(21) Appl. No.: 17/735,986

(22) Filed: May 3, 2022

(51) Int. Cl.
*B66D 3/26* (2006.01)
*B66D 3/20* (2006.01)
*E21B 19/084* (2006.01)

(52) U.S. Cl.
CPC ..... *B66D 3/26* (2013.01); *B66D 3/20* (2013.01); *E21B 19/084* (2013.01)

(58) Field of Classification Search
CPC ... B66D 1/40; B66D 1/54; B66D 3/26; B66D 3/20; E21B 19/08; E21B 19/084; E21B 19/166; E21B 44/02
See application file for complete search history.

(56) References Cited

U.S. PATENT DOCUMENTS 696,252 A * 3/1902 McManus ..... B66D 3/14 254/378
3,759,489 A * 9/1973 Jones ..... E21B 19/08 254/273
4,334,217 A 6/1982 Nield et al.
4,679,469 A * 7/1987 Coyle, Sr. ..... E21B 19/166 173/177
RE33,526 E * 1/1991 Coyle, Sr. ..... B25B 23/145 173/177
6,276,449 B1 8/2001 Newman
6,377,189 B1 4/2002 Newman
6,745,487 B1 * 6/2004 Nield ..... E21B 47/04 33/735
7,138,925 B2 * 11/2006 Nield ..... E21B 44/02 340/685
7,513,338 B2 * 4/2009 Newman ..... B66D 5/10 188/204 A
7,559,411 B2 * 7/2009 Michel ..... B61H 13/02 74/505

(Continued)

FOREIGN PATENT DOCUMENTS

CN 111305800 A * 6/2020
WO WO-2004048249 A1 * 6/2004 ..... B66C 13/50

OTHER PUBLICATIONS

OE; NOV Energy Recovery System for Offshore Rigs Gets Corvus ESS; www.oedigital.com/news/483117-nov-energy-recovery-system-for-offshore-rigs-gets-corvus-ess; 4 pages; publication date: Nov. 11, 2020.

(Continued)

*Primary Examiner* — Michael E Gallion
(74) *Attorney, Agent, or Firm* — bobharter.com; Robert J. Harter

(57) ABSTRACT

A method for limiting the speed of a hoist mounted to a mobile well service rig involves determining a safe speed limit that ensures the hoist's capable stopping time is less than the maximum allowed time for stopping. In some examples, the maximum allowed time for stopping is based on the wellstring's modulus of elasticity and independent of the hoist's braking characteristics. The capable stopping time, however, is independent of the wellstring's modulus of elasticity and dependent on the hoist's braking characteristics.

19 Claims, 7 Drawing Sheets

(56) References Cited

U.S. PATENT DOCUMENTS

| | | | | |
|---|---|---|---|---|
| 7,717,193 | B2 | 5/2010 | Egilsson et al. | |
| 10,035,687 | B2 * | 7/2018 | Nield | B66D 5/26 |
| 2002/0153134 | A1 | 10/2002 | Newman | |
| 2002/0156582 | A1 * | 10/2002 | Newman | E21B 41/00 702/5 |
| 2003/0042020 | A1 * | 3/2003 | Newman | E21B 47/00 166/250.15 |
| 2003/0196798 | A1 * | 10/2003 | Newman | E21B 47/00 166/250.01 |
| 2004/0065874 | A1 | 4/2004 | Newman | |
| 2004/0162658 | A1 | 8/2004 | Newman | |
| 2004/0192507 | A1 * | 9/2004 | Newman | E21B 41/0021 477/181 |
| 2005/0103491 | A1 | 5/2005 | Newman | |
| 2009/0057630 | A1 | 3/2009 | Newman | |
| 2009/0063054 | A1 | 3/2009 | Newman | |
| 2011/0174538 | A1 * | 7/2011 | Chan | E21B 19/08 175/24 |
| 2013/0276291 | A1 * | 10/2013 | Huseman | E21B 19/164 81/57.11 |
| 2016/0204719 | A1 | 7/2016 | Lesanko | |
| 2017/0370358 | A1 | 12/2017 | Graybill | |
| 2022/0018199 | A1 * | 1/2022 | Skjold | E21B 34/06 |
| 2022/0162921 | A1 * | 5/2022 | Losh | E21B 43/128 |

OTHER PUBLICATIONS

Texas Administrative Code, Title 16, Part 1, Ch. 3, Rule 3.37 (Year: 2021).

POSI-STOP; Position Tracking System; Greenville, SC; https://posi-stop.com/posi-stop-system-products.php; 7 pages plus links; publicly available and retrieved for viewing on May 2, 2022.

* cited by examiner

ELECTRIC WELL SERVICE RIG WITH SPEED LIMITER

FIELD OF THE DISCLOSURE

This patent generally pertains to mobile electric service rigs for servicing wellbores at wellsites and more specifically to means for automatically limiting the cable drum speed of such service rigs.

BACKGROUND

Many oil and gas wells have years, or even decades, of economic production throughout their lifespan. These wells, however, require routine interventions to remain active. Wells are subject to adversities such as corrosive fluids and normal wear and tear, which can cause metal fatigue, embrittlement, holes in tubing, and damage to downhole pumps. Repair often involves removing and subsequently reinstalling thousands of feet of wellstring, such as a long string of sucker rods or tubing. A mobile service rig with a hoist is usually used for doing the work of lifting and lowering the wellstring.

While being raised or lowered by the hoist, rods and tubing can suddenly and expectedly snag and seize in the wellbore. This can be dangerous if the hoist is traveling too fast to stop before the wellstring or something else breaks or lets loose. So methods have been developed for limiting the speed of the hoist based on physical characteristics of the wellstring.

U.S. Pat. No. 7,717,193; by Egilsson et al, discloses a method for reducing the hoist's speed at known predefined flag locations, such as when the top of the wellstring approaches the upper crown of the hoist. Egilsson also teaches running heavier wellstrings slower. Conversely, U.S. Pat. No. 7,793,918; by Newman, teaches running longer wellstrings faster.

Both Egilsson and Newman have their drawbacks. Both rely on the operator's experience and quick reflexes to hit the brakes upon suddenly encountering an unexpected obstruction. Neither one discloses a sure way for preventing the operator from running heavy tubing at a speed limit meant for light sucker rods.

DETAILED DESCRIPTION

Figure 1:
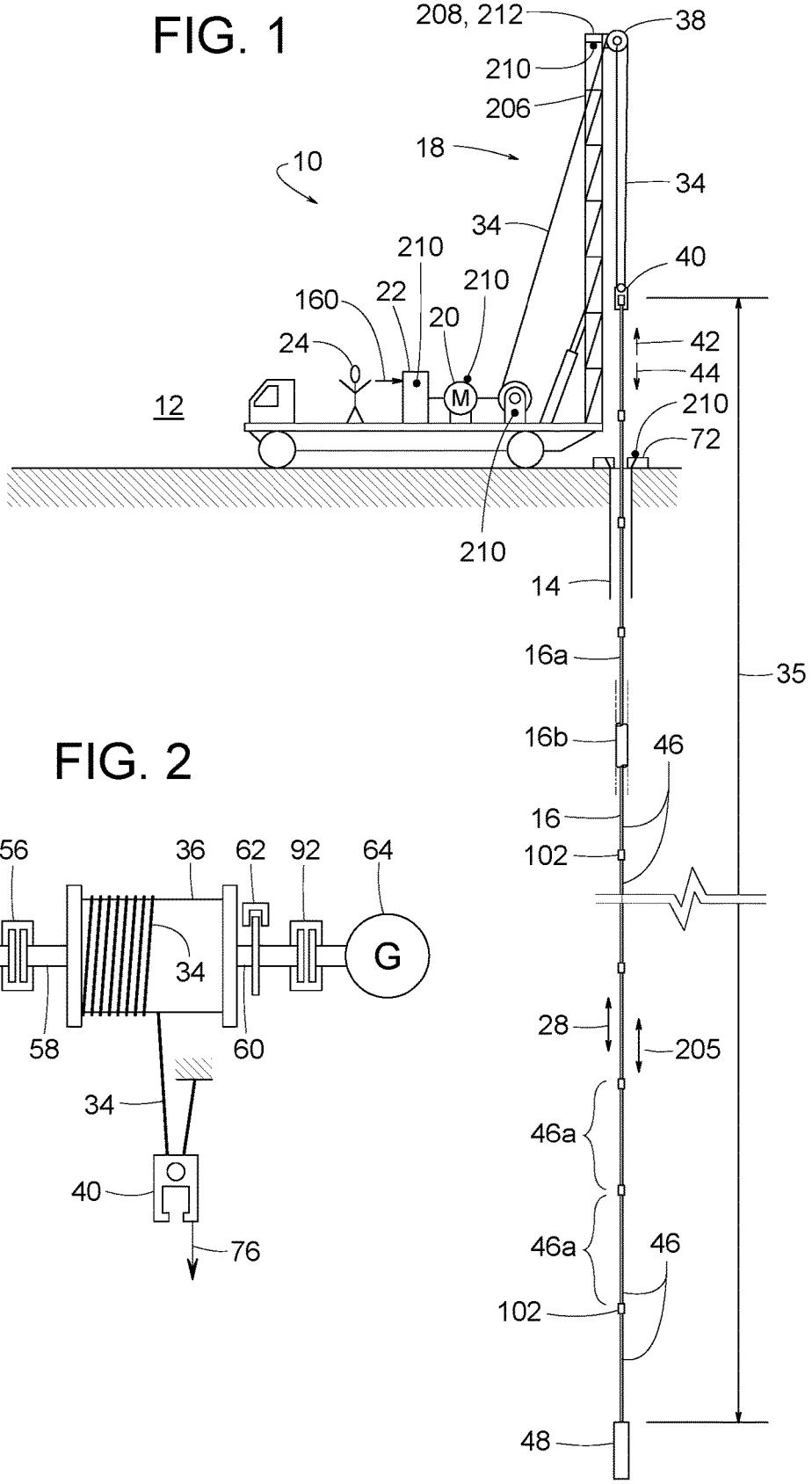
FIG. 1 is a schematic diagram of an example mobile service rig with a hoist connected to a string of sucker rods in a wellbore.

FIGS. 1-8 pertain to a mobile service rig 10 used at a wellsite 12 with wellbore 14 and used for installing or removing a wellstring 16 (e.g., a string of sucker rods 16*a* or a string of tubing 16*b*). The mobile service rig 10 includes a hoist 18 powered by an electric motor 20. A controller 22 limits how fast a human operator 24 can run the hoist 18. In some examples, the controller 22 determines a safe speed limit 26 (e.g., safe speed limits 26*a-d*) that ensures that the controller 22 has sufficient response time to automatically stop the hoist 18 in the event the wellstring 16 encounters an unexpected obstruction.

Controller 22 is schematically illustrated to represent any electrical circuit for strategically directing or modifying the flow of electricity. Some examples of controller 22 include a computer, a microprocessor, a programmable logic controller (PLC), electromechanical relays, a battery management system (BMS), an inverter, a rectifier, and various combinations thereof. In some examples, controller 22 is at a single location. In some examples, controller 22 is distributed over multiple locations. In some examples, controller 22 includes a computer readable medium having stored thereon, in a non-transitory state, an executable program code that, when executed, causes certain intended physical outcomes.

In some examples, the controller 22 calculates a capable stopping time 32, i.e., how fast it can stop the hoist 18. In some examples, this is calculated based on the wellstring's weight, the wellstring's velocity, a drag force 28 between the wellstring 16 and the wellbore 14, and the known braking characteristics of the hoist 18.

In some examples, the controller 22 also calculates a maximum allowed time for stopping 30 based on the amount of wellstring 16 (e.g., the wellstring's length 35 or weight), the wellstring's velocity, and whether the wellstring 16 is a string of sucker rods 16*a* or a string of tubing 16*b*. In some examples, the wellstring's length, weight, and physical structure (e.g., tubing or rods) can be used for determining the wellstring's modulus of elasticity.

The controller 22 then compares its calculated capable stopping time 32 to the maximum allowed time for stopping 30 the wellstring 16 before an accident occurs. The controller 22 establishes a safe speed limit 26 that ensures the capable stopping time 32 is less than the maximum allowed time for stopping 30. The term, "safe speed limit" refers to a maximum value that will likely avoid accidents.

There's a notable distinction between the capable stopping time 32 and the maximum allowed time for stopping 30. The maximum allowed time for stopping 30 is affected by the wellstring's modulus of elasticity but is independent of the hoist's braking characteristics. Conversely, the capable stopping time 32 is independent of the wellstring's modulus of elasticity but is dependent on the hoist's braking characteristics.

FIG. 1 shows the mobile service rig 10 at ground level adjacent the wellbore 14. The rig's hoist 18 comprises a cable 34 wrapped around a drum 36 rotatable by electric motor 20. From drum 36, cable 34 feeds over a crown pulley 38 and down to a set of pulley blocks and an elevator 40. In this example, the elevator 40 releasably connects to an upper end of the wellstring 16 (string of sucker rods 16*a*) such that the rods 16*a* hang from the hoist 18. The hoist 18 carries the weight of the rods 16*a* as the hoist 18 raises 42 or lowers 44 the rods 16*a* within the wellbore 14. The string of sucker rods 16*a* comprises a plurality of wellstring segments 46 (i.e., rod segments 46*a*) that are screwed together. A reciprocating pump 48 is attached to a lower end of the rods 16*a*.

Figure 2:
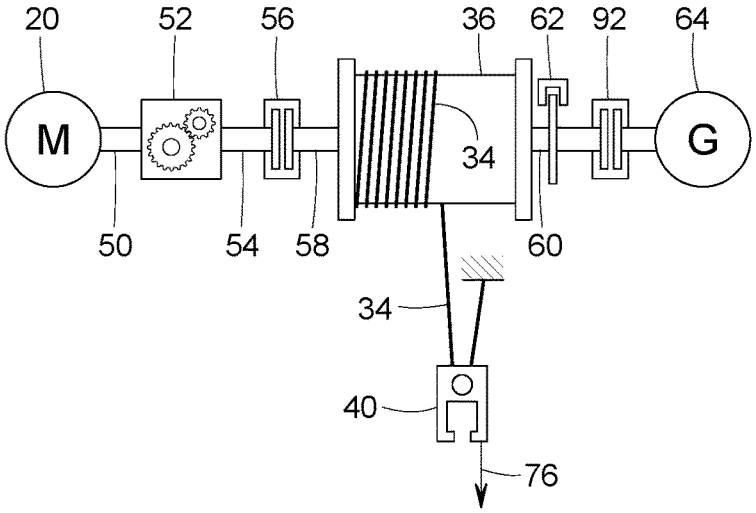
FIG. 2 is a schematic diagram of an example drive and brake system for an example hoist of a mobile service rig.

FIG. 2 shows one example of the electric motor 20 coupled to drive the rotation of drum 36. In this example, an output shaft 50 connects the electric motor 20 to a transmission 52 (e.g., a gearbox). A shaft 54 connects the transmission 52 to a clutch 56. Another shaft 58 connects clutch 56 to the hoist's drum 36. A shaft 60 connects to a brake 62 and an optional generator 64 via a clutch 92. In some examples, shafts 58 and 60 are integral extension of each other (i.e., a single common shaft supporting drum 36). The arrangement of components shown in FIG. 2 enables the rotational acceleration and deceleration of drum 36 without the need for a torque converter with an integral lockup clutch feature.

In some examples, brake 62 can be actuated automatically by controller 22 and/or actuated manually by the human operator 24. In some examples, to actuate brake 62, controller 22 and/or human operator 24 work in conjunction with a Posi-Stop System with a Spring Set Brake System as provided by Position Tracking Systems, of Greenville, S.C. In some examples, brake 62 is actuated to decelerate and stop the rotation of drum 36 and thus stop the traveling motion of the wellstring 16. In some examples, the optional generator 64 in conjunction with an electrical load provides regenerative braking to decelerate and/or stop the rotation of drum 36 and thus decelerate and/or stop the traveling motion of the wellstring 16.

Figure 3:
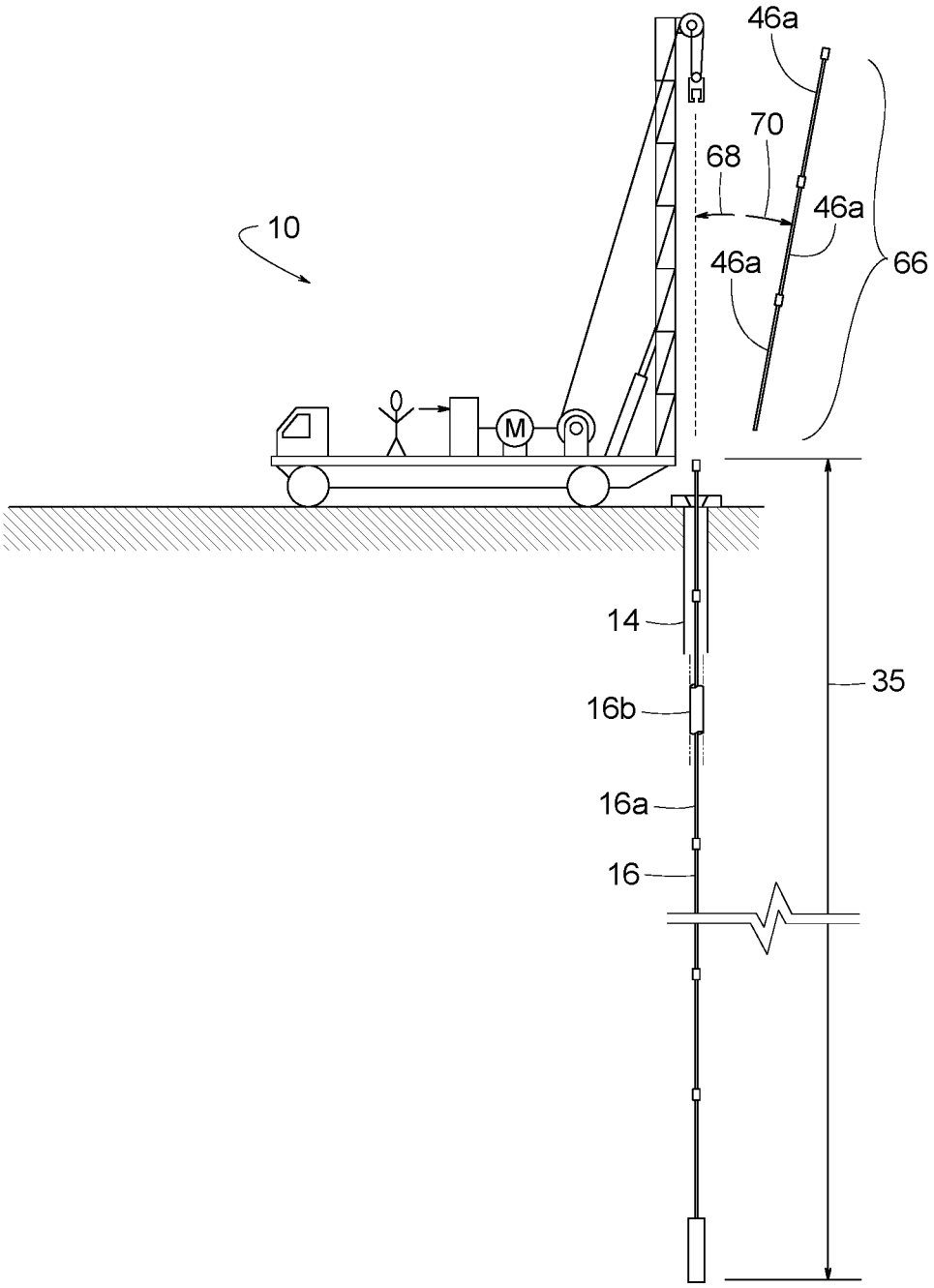
FIG. 3 is a schematic diagram similar to FIG. 3 but showing a set of three sucker rod segments being added or removed from the remaining string of sucker rods.

FIG. 3 shows a shorter length 35 of rods 16*a* in wellbore 14, while a stand or set 66 of three rod segments 46*a* (or some other number of rod segments 46*a*) are added 68 or removed 70 from the wellstring 16. While the hoist's elevator 40 is disconnected from the string of rods 16*a*, as shown in FIG. 3, a known slip apparatus 72 supports the weight of the string of rods 16*a* in the wellbore 14. The addition or removal of rod segments 46*a* can be repeated until the entire wellstring 16 is installed or removed.

Figure 4:
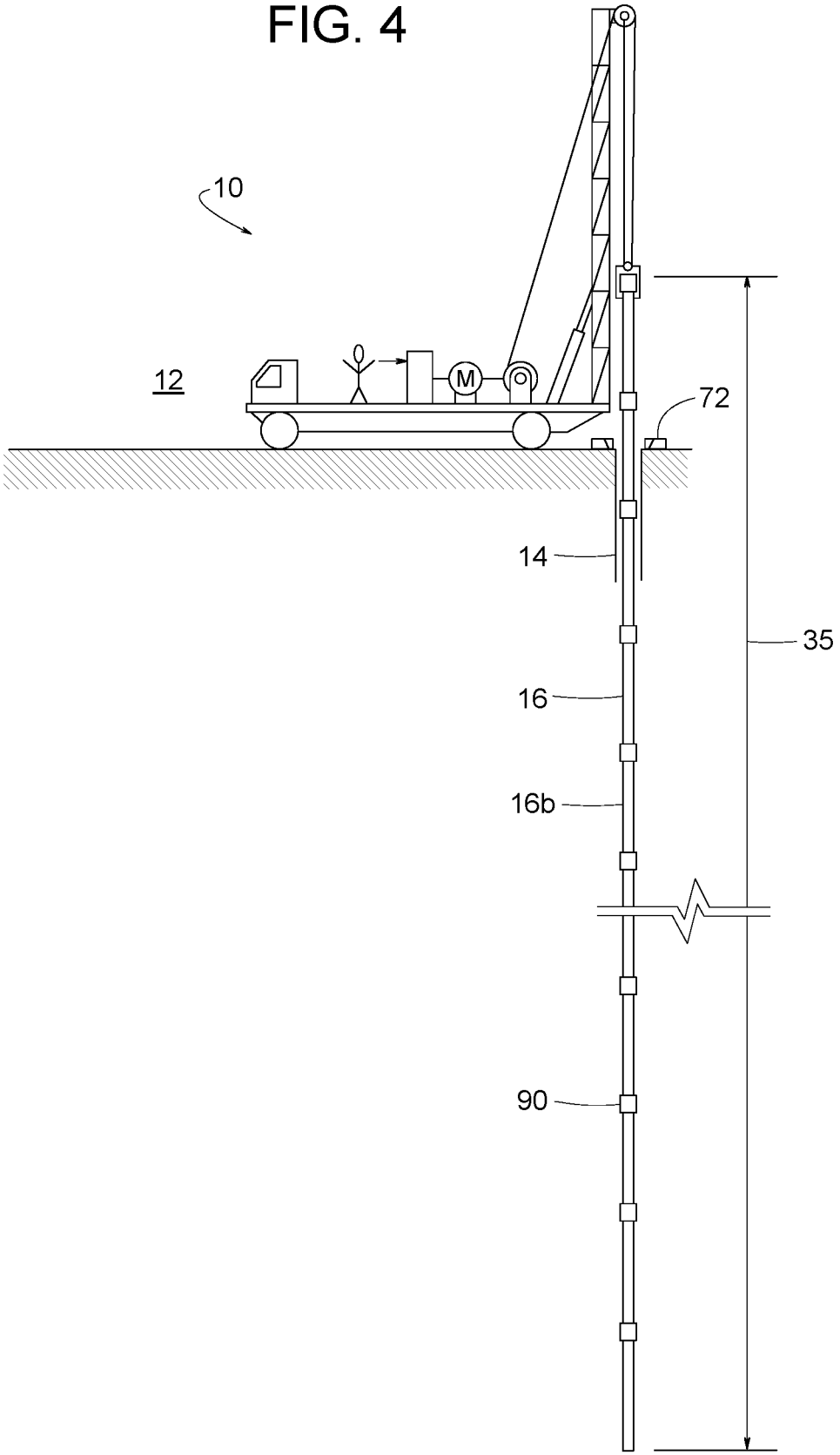
FIG. 4 is a schematic diagram similar to FIG. 1 but showing the hoist connected to a string of tubing in the wellbore.

FIG. 4 is similar to FIG. 1, but FIG. 4 shows rig 10 handling the string of tubing 16*b* instead of rods 16*a*. The tubing 16*b* is heavier and stiffer than rods 16*a*.

Figure 5:
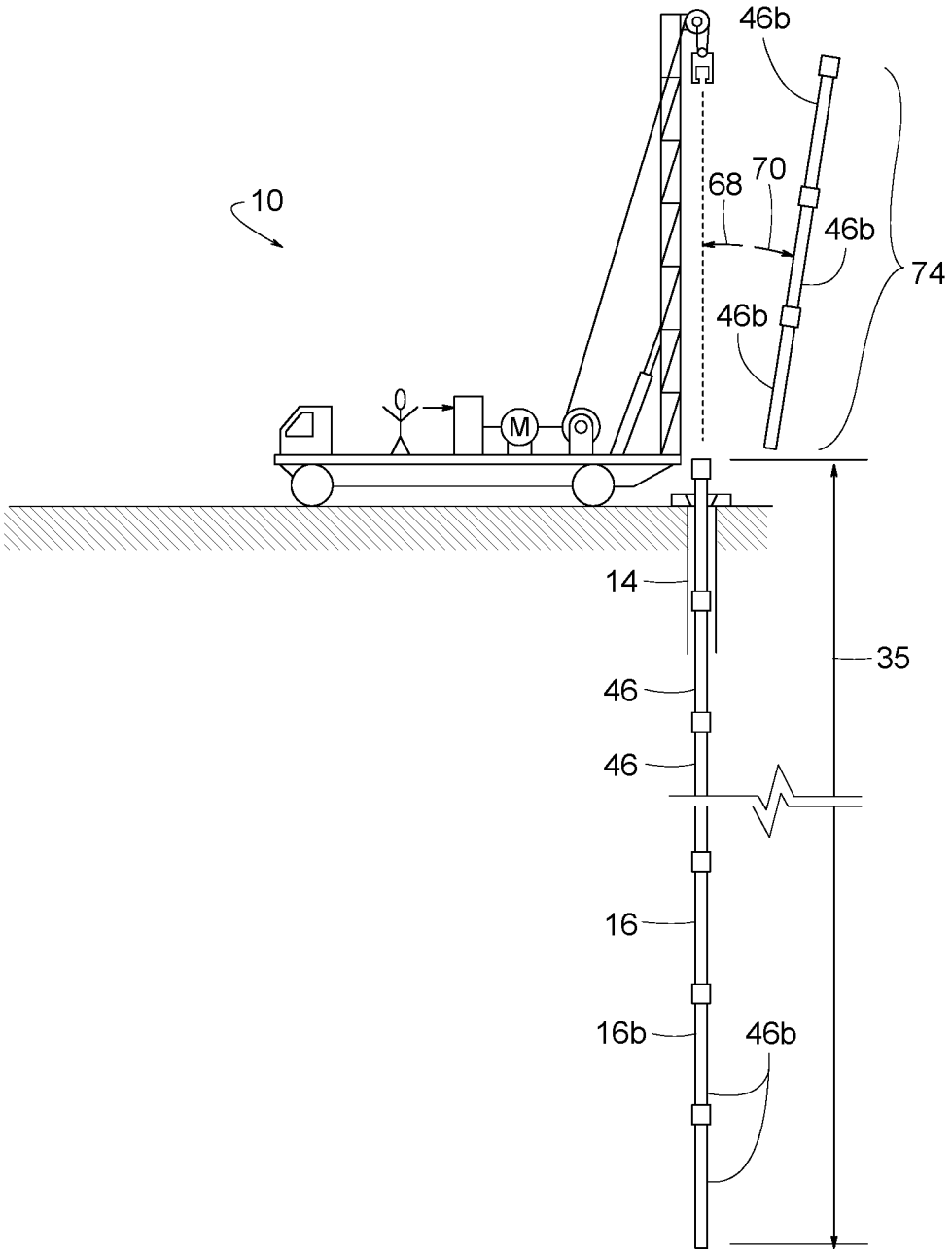
FIG. 5 is a schematic diagram similar to FIG. 4 but showing a set of three tube segments being added or removed from the remaining string of tubing.

FIG. 5 is similar to FIG. 3, but FIG. 5 shows a shorter length 35 of tubing 16*b* in wellbore 14, while a stand or set 74 of three tube segments 46*b* (or some other number of tube segments 46*b*) are added 68 or removed 70 from the wellstring 16. While the hoist's elevator 40 is disconnected from the sting of tubes 16*b*, as shown in FIG. 5, the slip apparatus 72 supports the weight of the string of tubes 16*b* in the wellbore 14. The addition or removal of tube segments 46*b* can be repeated until the entire wellstring 16 is installed or removed.

Figure 6:
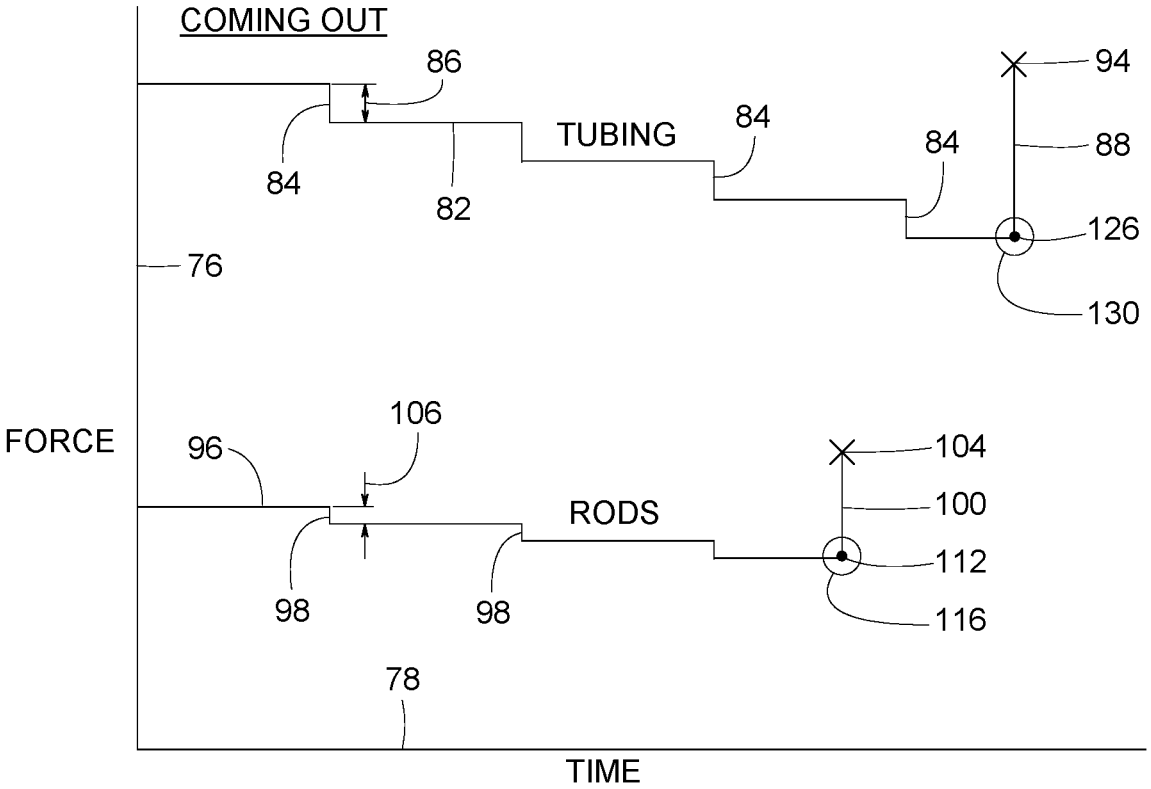
FIG. 6 show graphs illustrating how hoist force and wellstring speed vary with time, as the wellstring is incrementally disassemble and removed from a wellbore.
Figure 6:
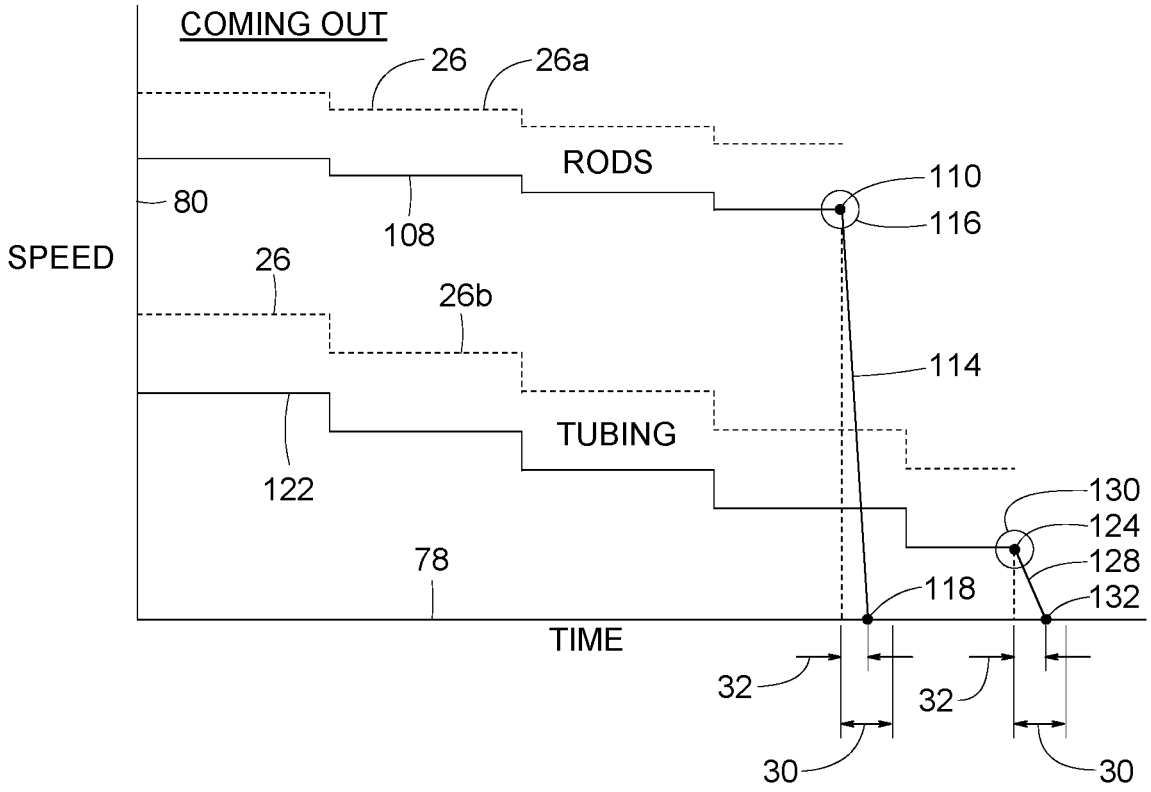
Figure 7:
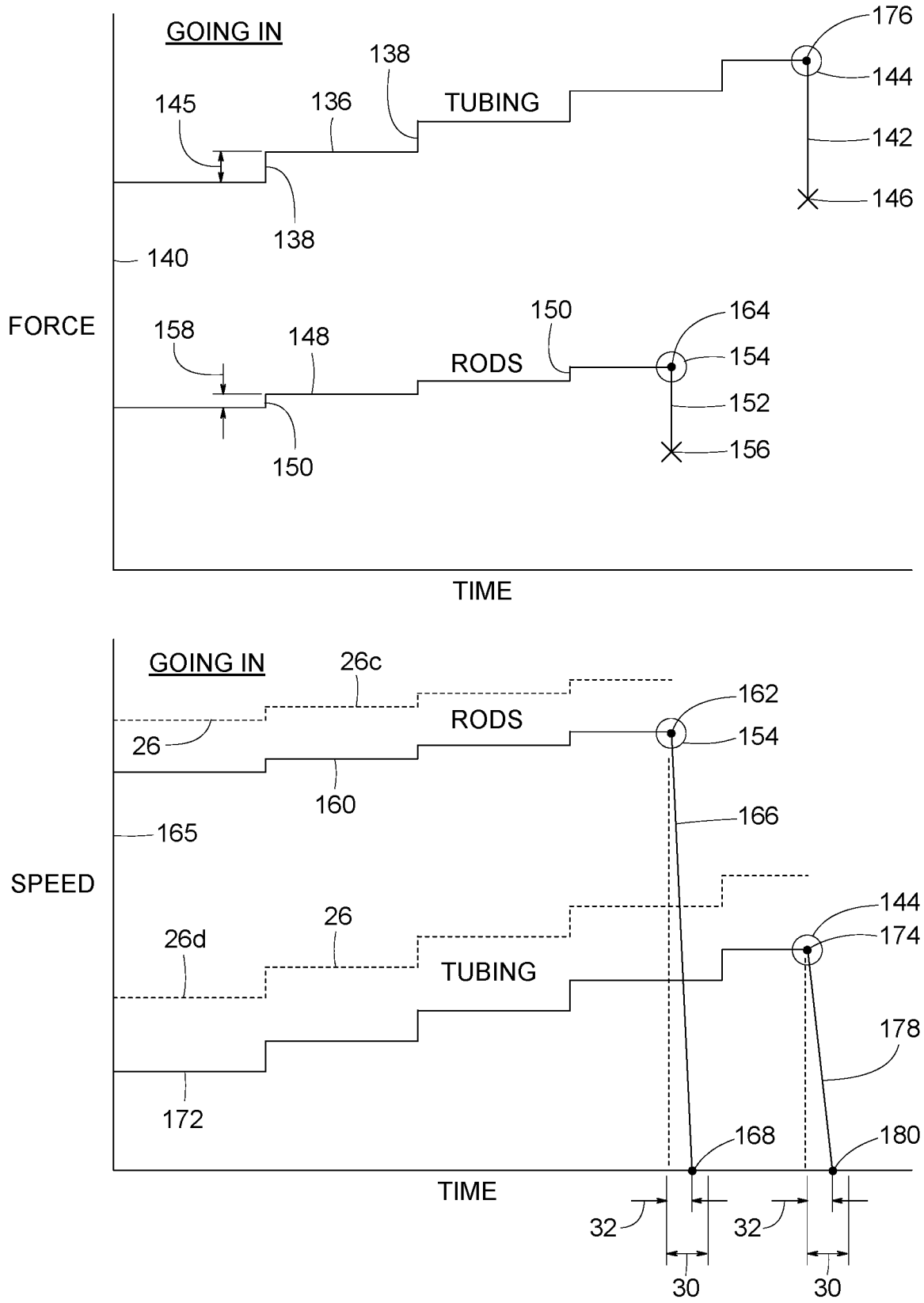
FIG. 7 show graphs illustrating how hoist force and wellstring speed vary with time, as the wellstring is incrementally assembled and lowered down into a wellbore.

The iterative process of installing or removing wellstring 16 is illustrated in FIGS. 6 and 7. FIG. 6 pertains to incrementally removing the wellstring 16 from wellbore 14. The upper half of FIG. 6 shows how the load or downward force 76 carried by the hoist 18 can vary over time 78. The lower half of FIG. 6 shows how the upward speed 80 of the wellstring 16 can vary over time 78.

A line 82 represents tubing 16*b* being incrementally removed from within wellbore 14. Each step 84 represents another set 74 of tube segments 46*b* being removed from wellstring 16. The amplitude 86 of each step 84 generally corresponds to the weight of each set 74 of tube segments 46*b*. While the load or downward force 76 carried by hoist 18 actually decreases to about zero at every step 86, because the slip apparatus 72 momentarily carries the full weight of the wellstring 16 at those points, that downward zero-spike is not shown in the drawings for sake of clarity.

A steep vertical section 88 of line 82 represents wellstring 16 encountering an unexpected significant resistance, such as one of the tubing collars 90 getting hung up on an obstruction in wellbore 14. In some examples, controller 22 is programmed to recognize such an abnormal, abrupt change in force 76 (force amplitude 86) and automatically initiates a braking action accordingly. The term, "braking action" refers to any procedure or method for reducing the speed of the wellstring 16.

In addition or alternatively, in some examples, the controller 22 emits an alarm that notifies the human operator 24 to initiate the braking action. In some examples, the braking action involves activating the brake 62, engaging a clutch 92 for regenerative braking via the generator 64, disengaging the clutch 56 to eliminate the affect of the electric motor's angular momentum, and/or engaging the clutch 56 to achieve regenerative braking via the electric motor 20. A point 94 at the upper end of section 88 marks the point in time when the wellstring 16 has come to a stop.

A line 96 represents the string of rods 16*a* being incrementally removed from within wellbore 14. Each step 98 represents another set 66 of rod segments 46*a* being removed from wellstring 16. While the load or downward force 76 carried by hoist 18 actually decreases to about zero at every step 98, because the slip apparatus 72 momentarily carries the full weight of the wellstring 16 at those points, that downward zero-spike is not shown in the drawings for sake of clarity.

A steep vertical section 100 of line 96 represents wellstring 16 encountering an unexpected significant resistance, such as one of the rod heads or couplings 102 getting hung up on an obstruction in wellbore 14. In some examples, controller 22 is programmed to recognize such an abnormal, abrupt change in force 76 and automatically initiates a braking action accordingly.

In addition or alternatively, in some examples, the controller 22 emits an alarm that notifies the human operator 24 to initiate the braking action. In some examples, the braking action involves activating the brake 62, engaging the clutch 92 for regenerative braking via the generator 64, disengaging the clutch 56 to eliminate the affect of the electric motor's angular momentum, and/or engaging the clutch 56 to achieve regenerative braking via the electric motor 20. A point 104 at the upper end of section 100 marks the point in time when the wellstring 16 has come to a stop.

The amplitude 106 of each step 98 generally corresponds to the weight of each set 66 of rod segments 46*a*. In some examples, the controller 22 makes a determination as to whether the hoist 18 is handling rods 16*a* or tubing 16*b* based on the amplitude of steps 86 and 106. This is referred to as a tube/rod determination. In some examples, the tube/rod determination is based on input from the human operator 24. The tube/rod determination can be used to help determine a safe speed limit 26*a* for removing the string of sucker rods 16*a*, a safe speed limit 26*b* for removing the string of tubing 16*b*, a safe speed limit 26*c* (FIG. 7) for inserting the string of sucker rods 16*a*, and a safe speed limit 26*d* (FIG. 7) for inserting the string of tubing 16*b*.

In the lower half of FIG. 6, a line 108 represents the example speed 80 at which the human operator 24 runs the hoist 18 over time when removing the sting of sucker rods 16*a*. The line 108 corresponds in time with the line 96 and pertains to removing the string of rods 16*a* in incremental steps. A point 110 of line 108 coincides with point 112 of line 96. A steep section 114 of line 108 represents hoist 18 decelerating and stopping in response to controller 22 detecting that the string of sucker rods 16*a* encountered the unexpected significant resistance 116. Point 118 represents the completion of the braking action with dimension 32 representing the time it took to stop the hoist 18. Dimension 30 represents the maximum allowed time for stopping before an accident might occur. A dashed line 26*a* above line 108 represents a safe speed limit for the hoist 18. In some examples, the safe speed limit 26*a*, as determined by the controller 22, incrementally decreases with time because the string of sucker rods 16*a* gets progressively shorter and thus less springy. The reduced springiness of a relatively short string of sucker rods 16*a* is less tolerant of stretching when the string of sucker rods 16*a* is stuck, thus it becomes more important to stop the hoist 18 as quickly possible. That is hard to do if the hoist 18 is going too fast.

On the other hand, a shorter string of sucker rods 16*a* is lighter than a longer one, so some examples of brake 62 might be able to stop a lighter string of sucker rods 16*a* more quickly. So, in some examples, controller 22 considers both the wellstring's length (for springiness) and its weight (for momentum) to determine a reliable safe speed limit 26*a*. In some examples, the safe speed limit 26*a* is calculated by applying known principles of physics (e.g., mechanical dynamics, fluid dynamics, momentum, deceleration, friction, etc.) to chosen configurations of hoist brake systems and wellstrings. In some examples, the safe speed limit 26*a* is determined simply by testing examples of actual brake systems of hoists handling examples of actual wellstrings 16.

A line 122, in the lower half of FIG. 6, corresponds in time with the line 82 and pertains to removing the string of tubing 16*b* in incremental steps. A point 124 of line 122 coincides with point 126 of line 82. A steep section 128 of line 122 represents hoist 18 decelerating and stopping in response to controller 22 detecting that the string of tubing 16*b* encountered the unexpected significant resistance 130. Point 132 represents the completion of the stopping action with dimension 32 representing the time it took to stop the hoist 18. Dimension 30 represents the maximum allowed time for stopping before an accident might occur. A dashed line 26*b* above line 122 represents a safe speed limit for the hoist 18. In some examples, the safe speed limit 26*b*, as determined by the controller 22, incrementally decreases with time because the string of tubing 16*b* gets progressively shorter and thus less springy. The reduced springiness of a relatively short string of tubing 16*b* is less tolerant of stretching when the string of sucker rods 16*b* is stuck, thus it becomes more important to stop the hoist 18 as quickly possible. That is hard to do if the hoist 18 is traveling too fast.

On the other hand, a shorter string of tubing 16*b* is lighter than a longer one, so some examples of brake 62 might be able to stop a lighter string of tubing 16*b* more quickly. So, in some examples, controller 22 considers both the wellstring's length (for springiness) and its weight (for momentum) to determine a reliable safe speed limit 26*b*. In some examples, the safe speed limit 26*b* is determined by testing examples of actual brake systems of hoists handling examples of actual wellstrings 16.

In the upper half of FIG. 7, a line 136 represents tubing 16*b* being incrementally inserted into wellbore 14. Each step 138 represents another set of tube segments 46*b* being added to wellstring 16. The amplitude 145 of each step 138 generally corresponds to the weight of each set 74 of tube segments 46*b*. While the load or downward force 140 carried by hoist 18 actually decreases to about zero at every step 138, because the slip apparatus 72 momentarily carries the full weight of the wellstring 16 at those points, that downward zero-spike is not shown in the drawings for sake of clarity.

A steep vertical section 142 of line 136 represents wellstring 16 encountering the unexpected significant resistance 144, such as one of the tubing collars 90 getting hung up on an obstruction in wellbore 14. In some examples, controller 22 is programmed to recognize such an abnormal, abrupt change in force 140 and automatically initiates a braking action accordingly. The term, "braking action" refers to any procedure or method for reducing the speed of the wellstring 16.

In addition or alternatively, in some examples, the controller 22 emits an alarm that notifies the human operator 24 to initiate the braking action. In some examples, the braking action involves activating the brake 62, engaging the clutch 92 for regenerative braking via the generator 64, disengaging the clutch 56 to eliminate the affect of the electric motor's angular momentum, and/or engaging the clutch 56 to achieve regenerative braking via the electric motor 20. A point 146 at the lower end of section 142 marks the point in time when the wellstring 16 has come to a stop.

A line 148 represents rods 46*a* being incrementally inserted into wellbore 14. Each step 150 represents another set 66 of rods segments 46*a* being added to wellstring 16. While the load or downward force 140 carried by hoist 18 actually decreases to about zero at every step 150, because the slip apparatus 72 momentarily carries the full weight of the wellstring 16 at those points, that downward zero-spike is not shown in the drawings for sake of clarity.

A steep vertical section 152 of line 148 represents wellstring 16 encountering an unexpected significant resistance 154, such as one of the rod heads or couplings 102 getting hung up on an obstruction in wellbore 14. In some examples, controller 22 is programmed to recognize such an abnormal, abrupt change in force 140 and automatically initiates a braking action accordingly.

In addition or alternatively, in some examples, the controller 22 emits an alarm that notifies the human operator 24 to initiate the braking action. In some examples, the braking action involves activating the brake 62, engaging the clutch 92 for regenerative braking via the generator 64, disengaging the clutch 56 to eliminate the affect of the electric motor's angular momentum, and/or engaging the clutch 56 to achieve regenerative braking via the electric motor 20. A point 156 at the lower end of section 156 marks the point in time when the wellstring 16 has come to a stop.

The amplitude 158 of each step 150 generally corresponds to the weight of each set of rod segments 46*a*. In some examples, the controller 22 makes a determination as to whether the hoist 18 is handling rods 46*a* or tubing 46*b* based on the amplitude of steps 138 and 158. This is referred to as a tube/rod determination. In some examples, the tube/rod determination is based on an input 160 from the human operator 24.

In the lower half of FIG. 7, a line 160 represents the example speed 165 at which the human operator 24 runs the hoist 18 over time. The line 160 corresponds in time with the line 148 and pertains to inserting the string of rods 16*a* in incremental steps. A point 162 of line 160 coincides with point 164 of line 148. A steep section 166 of line 160 represents hoist 18 decelerating and stopping in response to controller 22 detecting that the string of sucker rods 16*a* encountered the unexpected significant resistance 154. Point 168 represents the completion of the stopping action with dimension 32 representing the time it took to stop the hoist 18. A dimension 30 represents the maximum allowed time for stopping before an accident might occur. A dashed line 26*c* above line 160 represents a safe speed limit for the hoist 18. In some examples, the safe speed limit 26*c*, as determined by the controller 22, incrementally increases with time because the string of sucker rods 16*a* gets progressively longer and thus more springy. The greater springiness of a relatively long string of sucker rods 16*a* is more tolerant of stretching when the string of sucker rods 16*a* is stuck, thus the hoist 18 has more time to stop.

On the other hand, a longer string of sucker rods 16*a* is heavier than a shorter one, so some examples of brake 62 might find it more difficult to stop a relatively long string of sucker rods 16*a*. So, in some examples, controller 22 considers both the wellstring's length (for springiness) and its weight (for momentum) to determine a reliable safe speed limit 26*c*. In some examples, the safe speed limit 26*c* is calculated by applying known principles of physics (e.g., mechanical dynamics, fluid dynamics, momentum, deceleration, friction, etc.) to a chosen configurations of hoist brake systems and wellstrings. In some examples, the safe speed limit 26*c* is determined simply by testing examples of actual brake systems of hoists handling examples of actual wellstrings 16.

A line 172, in the lower half of FIG. 7, corresponds in time with the line 136 and pertains to inserting the string of tubing 16*b* in incremental steps. A point 174 of line 172 coincides with point 176 of line 136. A steep section 178 of line 172 represents hoist 18 decelerating and stopping in response to controller 22 detecting that the string of tubing 16*b* encountered the unexpected significant resistance 144. Point 180 represents the completion of the stopping action with dimension 32 representing the time it took to stop the hoist 18. A dimension 30 represents the maximum allowed time for stopping 18 before an accident might occur. Dashed line 26*d* above line 172 represents a safe speed limit 26*d* for the hoist 18. The safe speed limit 26*d*, as determined by the controller 22, incrementally increases with time because the string of tubing 16*b* gets progressively longer and thus more springy. The greater springiness of a relatively long string of tubing 16*b* is more tolerant of stretching when the string of tubing 16*b* is stuck, thus there is more time to stop the hoist 18.

On the other hand, a longer string of tubing 16*b* is heavier than a shorter one, so some examples of brake 62 might need more time to stop the heavier string of sucker rods 16*b*. So, in some examples, controller 22 considers both the wellstring's length (for springiness) and its weight (for momentum) to determine a reliable safe speed limit 26*d*. In some examples, the safe speed limit 26*d* is determined by testing examples of actual brake systems of hoists handling examples of actual wellstrings 16.

Figure 8:
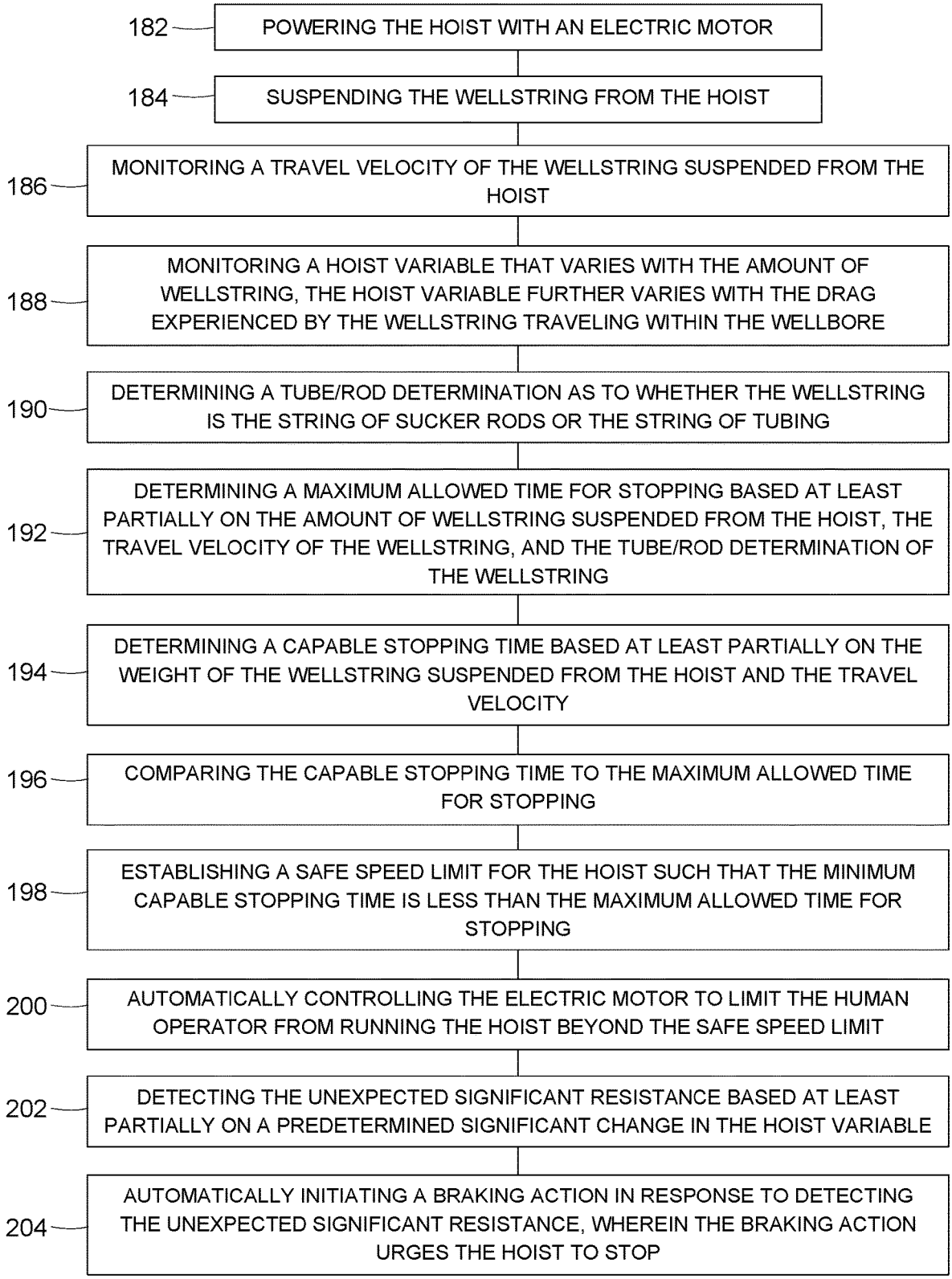
FIG. 8 is a flow diagram showing various methods for limiting the speed of a hoist associated with the mobile service rig shown in FIG. 1.

FIG. 8 illustrates various mobile service rig method steps. In some examples, some of the steps are optional and can be omitted. In some examples, the steps can be performed in a different sequence or concurrently. In some examples, the method steps can be performed by at least one of the mobile service rig 10, the controller 22 of mobile service rig 10, the human operator 24, and one or more sensors associated with mobile service rig 10 or wellsite 12.

Block 182 in FIG. 8 represents powering the hoist 18 with the electric motor 20. Block 184 and FIGS. 1 and 4 illustrate suspending the wellstring 16 from the hoist 18. Block 186 represents monitoring a travel velocity 206 of the wellstring 16 suspended from the hoist 18. In some examples, a sensor 208 (e.g., encoder, resolver, Hall Effect sensor, etc.) connected to some rotating or otherwise moving portion of mobile service rig 10 provides the controller 22 with RPM and/or other information that indicates the travel velocity 206 of the wellstring 16. Some examples of such moving portions include the drum 36, the electric motor 20, and the crown pulley 38. Points 210 indicate some example locations of sensor 208. In some examples, the travel velocity 205 includes both speed and direction.

Block 188 represents monitoring a hoist variable (e.g., force 76 or 140) that varies with the amount of wellstring 16 suspended by the hoist 18. In some examples, the hoist variable further varies with the drag forces 28 experienced by the wellstring 16 traveling through the wellbore 14. In some examples, the hoist variable includes the wellstring's weight. In some examples, the hoist variable includes the wellstring's length 35. In some examples, the drag forces 28 include frictional and fluidic forces applied to the wellstring 16 within the wellbore 14. In some examples, the hoist variable is sensed by a sensor 212 such as a known strain gage or a known load cell associated with the hoist 18 such as its mast 206. In some examples, the sensor 212 senses the current associated with the electric motor 20. Points 210 identify some example locations for the sensor 212 of the hoist variable.

Block 190 represents determining a tube/rod determination as to whether the wellstring 16 is the string of sucker rods 16*a* or the string of tubing 16*b*. In some examples, the tube/rod determination is determined based on the incremental weight added to or removed from the wellstring 16 when the wellstring 16 is incrementally inserted or removed from the wellbore 14. In some examples, the tube/rod determination is determined by the human operator 24 inputting that information into the controller 22.

Block 192 represents determining the maximum allowed time 30 for stopping the wellstring 16 based at least partially on the amount of wellstring 16 suspended from the hoist 18 (e.g., more wellstring weight generally requires more time to stop), the travel velocity 205 of the wellstring 16 (e.g., more speed generally means less time for stopping), and the tube/rod determination of the wellstring (e.g., rods and tubing might need different times for stopping). In some examples, a heavier or longer wellstring 16 can be springier, thus more time can be allowed for stopping it. In some examples, a faster wellstring 16 would need to be stopped sooner before it overstretches. In some examples, accidents or damage can occur if the wellstring 16 overstretches or breaks or something else breaks when the top of the wellstring 16 is traveling upward while a lower portion of the wellstring 16 encounters an unexpected significant resistance 116 or 130. In some examples, accidents or damage can occur if the wellstring 16 compresses, buckles, or pops out of elevator 40 or something possibly breaks when the top of the wellstring 16 is traveling downward while a lower portion of the wellstring 16 encounters an unexpected significant resistance 144 or 154. So in some examples, the maximum allowed time for stopping 30 is based on velocity, which has components of both speed and direction. Dimensions 30 of FIGS. 6 and 7 represent examples of maximum allowed times for stopping.

Block 194 represents determining a capable stopping time based at least partially on the weight of the wellstring 16 suspended from the hoist 18 and the travel velocity 205 (speed and up/down direction). Dimensions 32 of FIGS. 6 and 7 represent examples of capable stopping times 32. In some examples, the capable stopping time 32 is less going up than down because the wellstring's weight helps slow the wellstring 16 when it is traveling upward.

Block 196 represents comparing the capable stopping time 32 to the maximum allowed time for stopping 30.

Block 198 represents establishing a safe speed limit (e.g., safe speed limits 26*a* and 26*b* of FIG. 6 and safe speed limits 26*c* and 26*d* of FIG. 7) for the hoist 18 such that the capable stopping time 32 is less than the maximum allowed time for stopping 30.

Block 200 represents automatically controlling the electric motor 20 to limit the human operator 24 from running the hoist 18 beyond the safe speed limit 26. In some examples, the controller 22 allows the human operator 24 to control the hoist's speed, provided the human operator 24 does not exceed the safe speed limit 26.

Block 202 represents detecting an unexpected significant resistance based at least partially on a predetermined significant change 88, 100, 142, 152 in the hoist variable (e.g., force 76 or 140). Examples of a predetermined significant change include the length of steep vertical sections 88 and 100 of FIG. 6 and the length of the steep vertical sections 142 and 152 of FIG. 7. In some examples, the controller 22 identifies the change in force as being significant when the absolute value of the change in force (length of steep vertical sections 88, 100, 142 and 152) exceeds a predetermined magnitude. Examples of an unexpected significant resistance include the string of sucker rods 16*a* or the pump 48 snagging an inner surface of the string of tubing 16*b*, the string of tubing 16*b* snagging an inner surface of a casing surrounding the string of tubing 16*b*, and the pump 48 being lowered into the wellbore 14 suddenly encountering a liquid surface level within the wellbore 14. Block 204 represents initiating a braking action in response to detecting the unexpected significant resistance, wherein the braking action urges the hoist 18 to stop.

While the illustrated examples pertain to hoist drums, they readily apply to sand drums as well. The illustrated examples are not limited to any particular speeds and weights; however, some example strings of tubing weigh 4.7 to 6.7 lbs/ft, some examples strings of sucker rods weigh 1.6 lbs/ft, some example strings of sucker rods are moved 7 ft/sec, and some example strings of tubing are moved 4 ft/sec. Additional details of example mobile service rigs, sensors, drive systems, brake systems, wellstrings, wellbores, hoists, hoist drums, and/or sand drums, can be found in patent references US 2009/0057630; U.S. Pat. Nos. 7,717,193; 4,334,217; 10,035,687; U.S. patent application Ser. No. 17/497,829; U.S. patent application Ser. No. 17/698,736; U.S. patent application Ser. No. 17/713,551; and U.S. patent application Ser. No. 17/728,898; all of which are hereby incorporated herein by reference in their entirety.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

The invention claimed is:

1. A method for limiting the speed of a hoist mounted to a mobile well service rig, wherein the hoist is run by a human operator with the assistance of a controller, the hoist is configured to suspend a wellstring within a wellbore, the wellstring comprising a series of wellstring segments, the wellstring being one of a string of sucker rods and a string of tubing, the wellstring has a wellstring weight that varies depending on the number of wellstring segments, the wellstring has a wellstring length that varies depending on the number of wellstring segments, an amount of wellstring suspended from the hoist can varying depending on the number of wellstring segments, the amount of wellstring can be with reference to one of the wellstring length and the wellstring weight, the hoist enables the wellstring to travel within the wellbore, the wellstring can experience a drag force including a resistance upon traveling within the wellbore, the method comprising:

powering the hoist with an electric motor;

suspending the wellstring from the hoist;

monitoring a travel velocity of the wellstring suspended from the hoist;

monitoring a hoist variable that varies with the amount of wellstring, the hoist variable further varies with the drag experienced by the wellstring traveling within the wellbore;

determining a tube/rod determination as to whether the wellstring is the string of sucker rods or the string of tubing;

determining a maximum allowed time for stopping based at least partially on the amount of wellstring suspended from the hoist, the travel velocity of the wellstring, and the tube/rod determination of the wellstring;

determining a capable stopping time based at least partially on the weight of the wellstring suspended from the hoist and the travel velocity;

comparing the capable stopping time to the maximum allowed time for stopping;

establishing a safe speed limit for the hoist such that the capable stopping time is less than the maximum allowed time for stopping;

automatically controlling the electric motor to limit the human operator from running the hoist beyond the safe speed limit;

detecting the resistance based at least partially on (a) the hoist variable increasing while the wellstring is traveling upward or (b) the hoist variable decreasing while the wellstring is traveling downward; and initiating a braking action in response to detecting the resistance, wherein the braking action urges the hoist to stop.

2. The method of claim 1, further comprising completing the braking action within the maximum allowed time for stopping.

3. The method of claim 1, wherein determining the tube/rod determination is based at least partially on the hoist variable changing due to an incremental change in the wellstring weight as a wellstring segment is added to or removed from the series of wellstring segments.

4. The method of claim 1, wherein determining the tube/rod determination is achieved by the human operator entering an input into the controller.

5. The method of claim 1, wherein the controller at least helps in achieving at least one of monitoring the travel velocity of the wellstring suspended from the hoist, monitoring the hoist variable, determining the tube/rod determination, determining the maximum allowed time for stopping, determining the capable stopping time, comparing the capable stopping time to the maximum allowed time for stopping, establishing the safe speed limit for the hoist, automatically controlling the electric motor to limit the human operator from running the hoist beyond the safe speed limit, detecting the resistance, and initiating the braking action in response to detecting the resistance.

6. The method of claim 1, wherein determining the capable stopping time is based at least partially on the drag force experienced by the wellstring.

7. The method of claim 1, wherein the hoist includes a drum about which a cable is wrapped, the electric motor is coupled to the drum by way of a transmission and a clutch, the transmission is between the electric motor and the clutch, and the clutch is between the transmission and the drum.

8. The method of claim 7, wherein the clutch is engaged during the braking action such that both the electric motor and the drum decelerate to a stop during the braking action.

9. The method of claim 7, wherein the clutch is disengaged during the braking action such that the drum decelerates to a stop during the braking action while the electric motor can continue rotating.

10. The method of claim 1, wherein the amount of wellstring is with reference to the wellstring weight, the hoist variable varies with the wellstring weight, and monitoring the hoist variable involves the use of at least one of a strain gage and a force sensor.

11. The method of claim 1, wherein the amount of wellstring is with reference to the wellstring length, the hoist variable varies with the wellstring length, and monitoring the hoist variable involves the use of at least one of an encoder and a resolver.

12. A method for limiting the speed of a hoist mounted to a mobile well service rig, wherein the hoist is run by a human operator with the assistance of a controller, the hoist is configured to suspend a wellstring within a wellbore, the wellstring comprising a series of wellstring segments, the wellstring being one of a string of sucker rods and a string of tubing, the wellstring has a wellstring weight that varies depending on the number of wellstring segments, the wellstring has a wellstring length that varies depending on the number of wellstring segments, an amount of wellstring suspended from the hoist can varying depending on the number of wellstring segments, the amount of wellstring can be with reference to one of the wellstring length and the wellstring weight, the hoist enables the wellstring to travel within the wellbore, the wellstring can experience a drag force including a resistance upon traveling within the wellbore, the method comprising:

powering the hoist with an electric motor;

suspending the wellstring from the hoist;

monitoring a travel velocity of the wellstring suspended from the hoist, wherein the controller assists in monitoring the travel velocity of the wellstring;

monitoring a hoist variable that varies with the amount of wellstring, the hoist variable further varies with the drag experienced by the wellstring traveling within the wellbore, wherein the controller assists in monitoring the hoist variable;

determining a tube/rod determination as to whether the wellstring is the string of sucker rods or the string of tubing;

determining a maximum allowed time for stopping based at least partially on the amount of wellstring suspended from the hoist, the travel velocity of the wellstring, and the tube/rod determination of the wellstring, wherein the controller assists in determining the maximum allowed time for stopping;

determining a capable stopping time based at least partially on the weight of the wellstring suspended from the hoist and the travel velocity, wherein the controller assists in determining the capable stopping time;

comparing the capable stopping time to the maximum allowed time for stopping;

establishing a safe speed limit for the hoist such that the capable stopping time is less than the maximum allowed time for stopping, wherein the controller assists in establishing the safe speed limit for the hoist;

automatically controlling the electric motor to limit the human operator from running the hoist beyond the safe speed limit, wherein the controller assists in automatically controlling the electric motor;

detecting the resistance based at least partially on (a) the hoist variable increasing while the wellstring is traveling upward or (b) the hoist variable decreasing while the wellstring is traveling downward, wherein the controller assists in detecting the resistance; and automatically initiating a braking action in response to detecting the resistance, wherein the braking action urges the hoist to stop, and the controller assists in automatically initiating the braking action.

13. The method of claim 12, wherein determining the tube/rod determination is based at least partially on the hoist variable changing due to an incremental change in the wellstring weight as a wellstring segment is added to or removed from the series of wellstring segments.

14. The method of claim 12, wherein determining the capable stopping time is based at least partially on the drag force experienced by the wellstring.

15. A method for limiting the speed of a hoist mounted to a mobile well service rig, wherein the hoist is run by a human operator with the assistance of a controller, the hoist is configured to suspend a wellstring within a wellbore, the wellstring comprising a series of wellstring segments, the wellstring being one of a string of sucker rods and a string of tubing, the wellstring has a wellstring weight that varies depending on the number of wellstring segments, the wellstring has a wellstring length that varies depending on the number of wellstring segments, an amount of wellstring suspended from the hoist can varying depending on the number of wellstring segments, the amount of wellstring can be with reference to one of the wellstring length and the wellstring weight, the hoist enables the wellstring to travel within the wellbore, the wellstring can experience a drag force including a resistance upon traveling within the wellbore, the method comprising:

powering the hoist with an electric motor, wherein the hoist includes a drum about which a cable is wrapped, the electric motor is coupled to the drum by way of a transmission and a clutch, the transmission is between the electric motor and the clutch, and the clutch is between the transmission and the drum;

suspending the wellstring from the hoist;

monitoring a travel velocity of the wellstring suspended from the hoist, wherein the controller assists in monitoring the travel velocity of the wellstring;

monitoring a hoist variable that varies with the amount of wellstring, the hoist variable further varies with the drag experienced by the wellstring traveling within the wellbore, wherein the controller assists in monitoring the hoist variable;

determining a tube/rod determination as to whether the wellstring is the string of sucker rods or the string of tubing, wherein determining the tube/rod determination is based at least partially on the hoist variable changing due to an incremental change in the wellstring weight as a wellstring segment is added to or removed from the series of wellstring segments;

determining a maximum allowed time for stopping based at least partially on the amount of wellstring suspended from the hoist, the travel velocity of the wellstring, and the tube/rod determination of the wellstring, wherein the controller assists in determining the maximum allowed time for stopping;

determining a capable stopping time based at least partially on the weight of the wellstring suspended from the hoist, the travel velocity, and the drag force experienced by the wellstring; wherein the controller assists in determining the capable stopping time;

comparing the capable stopping time to the maximum allowed time for stopping;

establishing a safe speed limit for the hoist such that the capable stopping time is less than the maximum allowed time for stopping, wherein the controller assists in establishing the safe speed limit for the hoist;

automatically controlling the electric motor to limit the human operator from running the hoist beyond the safe speed limit, wherein the controller assists in automatically controlling the electric motor;

detecting the resistance based at least partially on (a) the hoist variable increasing while the wellstring is traveling upward or (b) the hoist variable decreasing while the wellstring is traveling downward, wherein the controller assists in detecting the resistance;

automatically initiating a braking action in response to detecting the resistance, wherein the braking action urges the hoist to stop, and the controller assists in automatically initiating the braking action; and completing the braking action within the maximum allowed time for stopping.

16. The method of claim 15, wherein the clutch is engaged during the braking action such that both the electric motor and the drum decelerate to a stop during the braking action.

17. The method of claim 15, wherein the clutch is disengaged during the braking action such that the drum decelerates to a stop during the braking action while the electric motor can continue rotating.

18. The method of claim 15, wherein the amount of wellstring is with reference to the wellstring weight, the hoist variable varies with the wellstring weight, and monitoring the hoist variable involves the use of at least one of a strain gage and a force sensor.

19. The method of claim 15, wherein the amount of wellstring is with reference to the wellstring length, the hoist variable varies with the wellstring length, and monitoring the hoist variable involves the use of at least one of an encoder and a resolver.

* * * * *